US011332853B2

(12) United States Patent
Cornille et al.

(10) Patent No.: US 11,332,853 B2
(45) Date of Patent: May 17, 2022

(54) TWISTING METHOD AND INSTALLATION WITH TENSION CONTROL FOR THE PRODUCTION OF REINFORCING CORDS FOR TIRES

(71) Applicant: Compagnie Generale Des Etablissements Michelin, Clermont-Ferrand (FR)

(72) Inventors: Richard Cornille, Clermont-Ferrand (FR); Christophe Hombert, Clermont-Ferrand (FR); Francis Aubarede, Clermont-Ferrand (FR)

(73) Assignee: Compagnie Generalé Des Etablissements Michelin, Clermont-Ferrand (FR)

( * ) Notice: Subject to any disclaimer, the term of this patent is extended or adjusted under 35 U.S.C. 154(b) by 44 days.

(21) Appl. No.: 16/954,101

(22) PCT Filed: Dec. 18, 2018

(86) PCT No.: PCT/FR2018/053386
§ 371 (c)(1),
(2) Date: Jun. 15, 2020

(87) PCT Pub. No.: WO2019/122698
PCT Pub. Date: Jun. 27, 2019

(65) Prior Publication Data

US 2021/0180219 A1 Jun. 17, 2021

(30) Foreign Application Priority Data

Dec. 22, 2017 (FR) ..... 1763110

(51) Int. Cl.
*D02G 3/48* (2006.01)
*D02G 3/28* (2006.01)
*D07B 3/00* (2006.01)

(52) U.S. Cl.
CPC ..... *D02G 3/48* (2013.01); *D02G 3/28* (2013.01); *D07B 3/00* (2013.01)

(58) Field of Classification Search
CPC ... D02G 3/28; D02G 3/48; D07B 3/00; D07B 2301/258; B65H 59/388
See application file for complete search history.

(56) References Cited

U.S. PATENT DOCUMENTS 3,828,538 A * 8/1974 Yoshida ..... D07B 3/10 57/58.54
4,087,956 A * 5/1978 Gre ..... D07B 3/00 57/58.54

(Continued)

FOREIGN PATENT DOCUMENTS

CN 201530945 U 7/2010
CN 106319712 A 1/2017

OTHER PUBLICATIONS

International Search Report issued in PCT/FR2018/053386 dated Apr. 11, 2019.

*Primary Examiner* — Shaun R Hurley
(74) *Attorney, Agent, or Firm* — Dickinson Wright PLLC; Steven C. Hurles

(57) ABSTRACT

The method for producing a wire element by interlacing at least a first strand and a second strand, during which strand tension control is effected by includes defining an assembly tension set point representative of a state of longitudinal tension to be obtained in the first strand when said first strand reaches the assembly point. The method also includes measuring the actual assembly tension applied in the first strand, said measurement being taken at a first tension measurement point located along the first strand and upstream of the assembly point. The method proceeds with operating a tension regulating member such as a capstan, which acts on the first strand upstream of the assembly point (Continued)

such as to cause the actual assembly tension within said first strand to converge automatically towards the assembly tension set point.

12 Claims, 1 Drawing Sheet

(56) References Cited

U.S. PATENT DOCUMENTS

| | | | | |
|---|---|---|---|---|
| 4,200,212 | A * | 4/1980 | Hartig | B65H 54/026 226/24 |
| 5,535,579 | A * | 7/1996 | Berry, III | B65H 59/385 57/13 |
| 5,772,136 | A * | 6/1998 | Gilbos | B65H 54/026 242/472.8 |
| 6,776,319 | B1 * | 8/2004 | Haselwander | B65H 23/1888 139/103 |
| 7,665,290 | B2 * | 2/2010 | Ueda | D07B 3/00 57/314 |
| 7,802,418 | B2 * | 9/2010 | Vega | D02G 3/28 57/58.54 |
| 2005/0133653 | A1 * | 6/2005 | Heaney | B65H 51/32 242/410 |
| 2006/0151081 | A1 * | 7/2006 | Ueda | D07B 3/00 152/451 |
| 2008/0098707 | A1 | 5/2008 | Vega | |
| 2015/0069166 | A1 * | 3/2015 | Nakagawa | B23H 7/104 242/412.1 |

* cited by examiner

UPSTREAM
DOWNSTREAM
6E
6D
6C
6B
6A
PT1
PV1
PT2
V_fwd
V_fwd_actual
T_actual
T_unwind_actual
T_unwind set
T_set
V_fwd_set
8,34,64
ω7

TWISTING METHOD AND INSTALLATION WITH TENSION CONTROL FOR THE PRODUCTION OF REINFORCING CORDS FOR TIRES

CROSS-REFERENCE TO RELATED APPLICATION

This application claims the benefit of PCT Application No. PCT/FR2018/053386, filed on Dec. 18, 2018, and titled "TWISTING METHOD AND INSTALLATION WITH TENSION CONTROL FOR THE PRODUCTION OF REINFORCING CORDS FOR TYRES" and of French Patent Application No. 1763110, filed Dec. 22, 2017, titled "TWISTING METHOD AND INSTALLATION WITH TENSION CONTROL FOR THE PRODUCTION OF REINFORCING CORDS FOR TYRES".

BACKGROUND OF THE INVENTION

1. Field of the Invention

The present disclosure relates to the field of producing wire elements, called "cords", through assembly by twisting several continuous strands, in particular textile threads.

More specifically, the present disclosure relates to the application of such an assembly method to the manufacture of reinforcing wire elements that are intended to be included in the formation of tires, in particular of pneumatic tires for vehicles.

2. Related Art

It is known that wire elements are produced by interlacing several strands with each other, by twisting, by means of a twisting device of the ring spinning machine type.

In general, the strands are stored on input reels, from which each strand is unwound to an assembly point, at which said strand is interlaced with the one or the other strands in order to form a wire element, called "cord".

The strands may have previously undergone a twisting operation, before being unwound and assembled, in order to have a certain amount of pre-torsion around their axis.

It is known for a motorized drive device, such as a capstan, to be provided along the considered strand, which device is placed between the input reel and the assembly point in order to impart a predetermined forward speed to the considered strand.

Furthermore, the wire element itself is driven, downstream of the assembly point, by a motorized output reel, onto which said wire element is wound as it is manufactured.

A ring spinning machine also includes a runner between the assembly point and the motorized output reel, which runner is movably mounted by freely sliding on a ring, coaxial to the axis of rotation of the output reel, and through which the wire element passes before meeting the reel.

Thus, the rotation of the reel generates traction on the wire element, which in turn causes a strain on the runner, which, in response, is rotationally routed along the ring and thus causes a twisting movement that causes the interlacing of the strands at the assembly point.

In practice, a suitable combination needs to be empirically determined between, on the one hand, a reel rotation speed, at which the motorized output reel can run, and, on the other hand, for each strand, a suitable forward speed, as imparted by the capstan upstream of the assembly point, so that the subtle dynamic balance of the runner movement, which is established during the application of this combination of speeds, allows a wire element to be obtained that has the desired qualities, in particular in terms of mechanical properties.

Therefore, it is sometimes difficult to develop such methods for manufacturing wire elements, and particularly to determine the speed adjustments for the capstan and the output reel that ensure that the desired properties of the wire element are obtained.

Furthermore, even when such adjustments are suitably determined, a risk of drift remains that is associated with the sensitivity of the method to the variations in the implementation conditions, and in particular with the sensitivity of the method to the fluctuations in friction that occur within the various mechanical components of the ring spinning machine, for example, on the unwinding elements or even on the runner.

Similarly, the behaviour of the runner is sensitive to the level of filling of the output reel, insofar as the orientation of the wire element that exits the runner to meet the reel varies according to whether the output reel is nearly empty, in which case the wire element, which has a low turn diameter, is practically radially oriented relative to the axis of the reel, and therefore is practically radially oriented relative to the axis of the ring that supports the runner, or whether, on the contrary, the output reel is full, in which case the wire element, which has a large turn diameter, is oriented practically tangentially to the outer perimeter of said reel.

Of course, the sensitivity of the method to the implementation conditions of the runner is potentially detrimental to the repeatability of the manufacturing method.

SUMMARY OF THE INVENTION

Consequently, the stated aims of the present disclosure aim to overcome the aforementioned disadvantages and to propose a new method and a new installation for manufacturing a wire element by interlacing strands, the implementation of which is facilitated, and which exhibits improved robustness and good repeatability.

Another stated aim of the present disclosure aims to propose a new method and a new installation for manufacturing wire elements that offers some versatility, by allowing a wide variety of manufacturing ranges of wire elements with distinct properties to be manufactured on demand and in a repeatable manner.

The stated aims of the present disclosure are achieved by means of a method for manufacturing a wire element by interlacing at least one first strand and one second strand distinct from the first strand, said method comprising the following steps:

- an infeed step (a), during which the first strand and the second strand, respectively, are routed to an assembly point, at which the first strand and the second strand meet;
- an interlacing step (b), during which the first strand and the second strand are interlaced with each other, at the assembly point, so as to form a wire element from said at least first and second strands, said method further comprising a strand tension control step (a1), in a closed loop, during which step:

- a tension setpoint, called "assembly tension setpoint", is defined that represents a longitudinal tension state intended to be obtained in the first strand when said first strand reaches the assembly point;
- the tension, called "actual assembly tension", that is exerted inside said first strand is measured at a first tension measurement point that is located along said first strand and upstream of the assembly point relative to the routing direction of said first strand;

a tension feedback loop is used to determine an error, called "tension error", that corresponds to the difference between the assembly tension setpoint and the actual assembly tension of the first strand; and a tension regulating component is controlled, on the basis of said tension error, which component acts on the first strand upstream of the assembly point, so as to automatically converge, inside said first strand, the actual assembly tension towards the assembly tension setpoint.

Indeed, the present disclosure have observed that, in a given number of situations, and in particular as a function of the type of strands that are used, the properties of the manufactured wire element could be closely dependent on the tension of the strands at the time of assembly.

Advantageously, the implementation of regulation of the tension of one or more strands, rather than of the speeds, therefore allows precise and repeatable control of the properties of the manufactured wire element.

Furthermore, such tension regulation allows at least partial compensation of possible fluctuations in friction in the twisting installation, which makes the method much less sensitive to said fluctuations in friction, in particular to the fluctuations in friction that occur upstream of the assembly point.

The method according to the present disclosure therefore is particularly robust and repeatable.

Furthermore, such a method not only allows better controlled industrial production to be implemented, but also allows the transition between the development and the industrialization of a new wire element to be facilitated.

Indeed, it is possible, by applying this method, to initially develop, on an installation providing tension regulation according to the present disclosure, a wire element with well defined properties, by setting a tension specification for one or more strands, then subsequently empirically deducing therefrom, by measuring the speeds resulting from the application of the tension regulation, corresponding adjustments intended for speed regulation, which, reciprocally, will allow the one or more desired tensions to be obtained with a reasonable amount of precision and repeatability, and which advantageously can be applied on existing mass production industrial machines that do not have tension regulation, but only have speed regulation.

According to one particularly preferable possibility, the method allows simultaneous tension control of one strand and speed control of the other strand, and even possibly allows selection, for at least one of the strands and even for each strand of the wire element, of tension control or of speed control, which particularly offers numerous possibilities of combinations when seeking new wire elements with particular properties.

It also will be noted that, advantageously, the interlacing that occurs at the assembly point somehow allows "freezing" of the properties that have been imparted to the wire element by virtue of the tension and/or speed controls selected for the various strands forming said wire element, and therefore allows the properties and advantages procured by the specific combination of these selected controls to be substantially maintained.

Furthermore, the method according to the present disclosure is perfectly applicable to the manufacture of a wire element using different strand lengths from one strand to the other, and in particular to the manufacture of wire elements called "covered" elements, a strand of which forms a central core, around which one or more other strands are helically wound.

BRIEF DESCRIPTION OF THE DRAWINGS

Further aims, features and advantages of the present disclosure will be revealed in greater detail upon reading the following description, as well as with reference to the accompanying drawings, which are provided solely by way of anon-limiting illustration and in which.

DETAILED DESCRIPTION FO THE ENABLING EMBODIMENT

Figures 1, 2, 3:
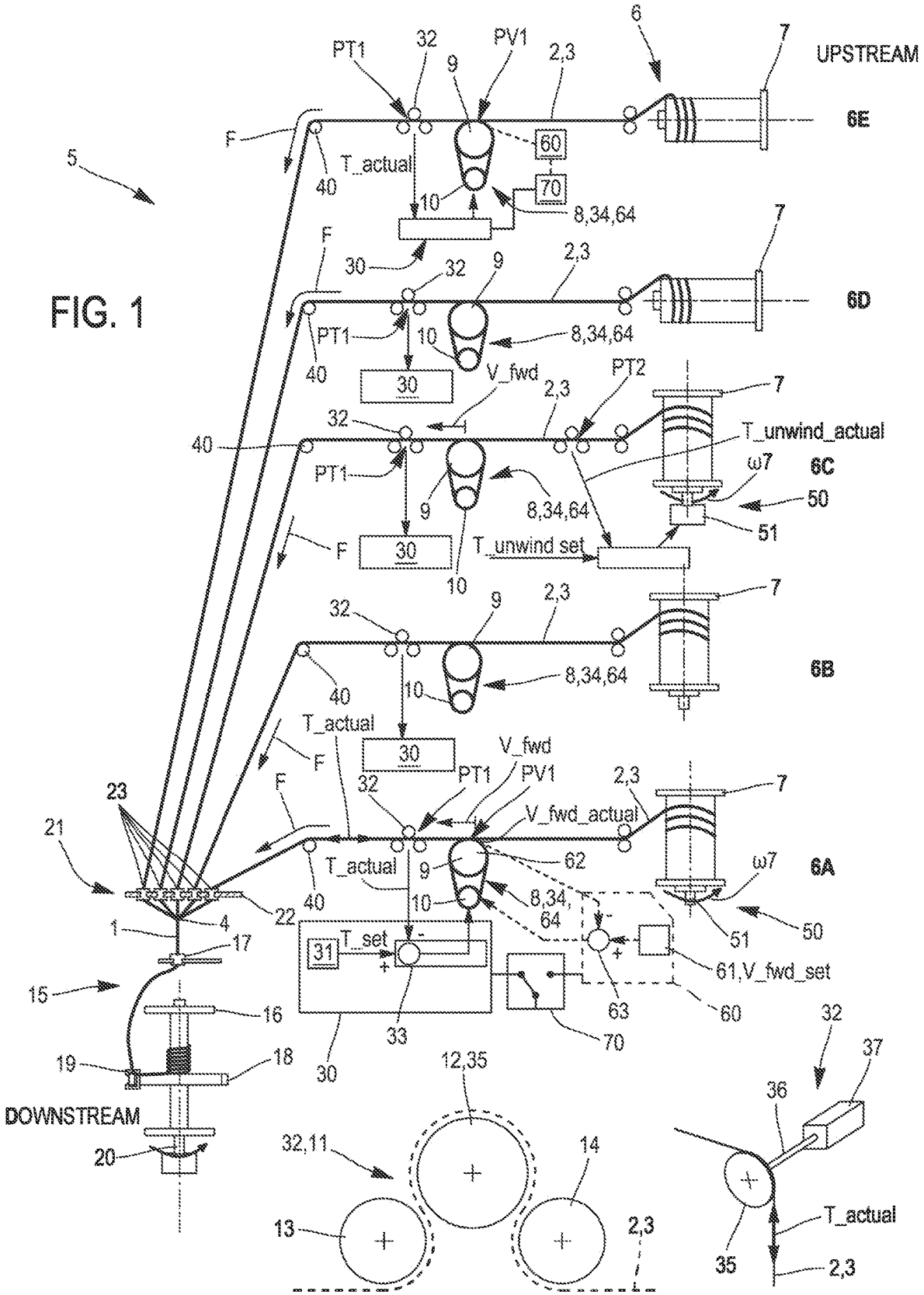
FIG. 1 shows a schematic view of an example of an installation of the ring spinning machine type, allowing the manufacturing method according to the present disclosure to be implemented.
FIG. 2 shows a schematic view of an arrangement of a "trio" of rollers that can be used, according to the configuration of the rollers and the routing of the strand through said rollers, either as a motorized drive device for implementing speed regulation, or as a tension monitoring component for measuring the tension of the strand.
FIG. 3 shows a schematic perspective view of an example of a tension monitoring component using a thread guide, of the pulley type, mounted on a resiliently deformable support formed by a cantilever beam.

The present present disclosure relates to a method for manufacturing a wire element 1 by interlacing at least one first strand 2 and one second strand 3, said second strand 3 being distinct from the first strand.

The wire element 1 that is thus obtained is also called a "cord".

The term "wire" denotes an element that longitudinally extends along a main axis, corresponding to the longitudinal direction, and which has a transverse section, perpendicular to the main axis, the largest dimension D of which is relatively small compared to the dimension L along the main axis. The term "relatively small" is understood to mean that L/D is greater than or equal to 100, preferably greater than or equal to 1000.

This definition also covers both wire elements 1 with a circular transverse section and wire elements 1 with a non-circular transverse section, for example, with a polygon or oblong transverse section. In the case of wire reinforcing elements with a non-circular transverse section, the ratio of the largest dimension D of the section to the smallest dimension d of the section may be, for example, greater than or equal to 20, preferably greater than or equal to 30 and more preferably greater than or equal to 50.

Typically, the wire element 1 can have a transverse section, the largest dimension D of which is between 0.05 mm and 5 mm, possibly, for example, between 0.2 mm and 2 mm and, more specifically, the transverse section of which is geometrically included in a cylinder, which is centered on the main axis of the wire element, the diameter of which is between 0.05 mm and 5 mm, possibly, for example, between 0.2 mm and 2 mm.

By way of an example, said wire element 1 can have a continuous length L that is equal to or greater than 1 m, 10 m, 100 m, even 1000 m and, for example, between 500 m and 100,000 m.

Similarly, each strand 2, 3 can have a transverse section, the largest dimension D of which is between 0.05 mm and 5 mm, possibly, for example, between 0.2 mm and 2 mm and, more specifically, the transverse section of which is geometrically included in a cylinder, which is centered on the main axis of the wire element, the diameter of which is between 0.05 mm and 5 mm, possibly, for example, between 0.2 mm and 2 mm.

By way of an example, the considered strand 2, 3 can have a continuous length L that is equal to or greater than 1 m, 10 m, 100 m, even 1000 m and, for example, between 500 m and 100,000 m.

The first strand 2 and/or the second strand 3 can be mono-filament, i.e. formed by a single monolithic filament, or even multi-filament, i.e. formed by a set of filaments forming a bundle.

The filament or the filaments forming the first strand 2 and the second strand 3, respectively, can be of any suitable type.

Preferably, textile filaments will be used, preferably made of polymer material, for example, of polyamide (Nylon™), aramide, rayon (fibre originating from wood cellulose), polyethylene terephthalate (PET), etc., or any combination of such polymer materials.

Of course, the method can be applied to the assembly of any number of strands 2, 3.

By way of an example, the number of strands 2, 3 used to form the wire element 1 can be between two and twelve strands, and particularly preferably between two and four strands.

In particular, a four-strand wire element 1 thus can be produced, comprising a central strand forming a core and three peripheral strands wound around said core.

For the sake of simplifying the description, when necessary reference can be made to, and a distinction can be made between, a first strand 2 and a second strand 3, bearing in mind that the features described with reference to the first strand 2 or the second strand 3 can be assigned and adapted mutatis mutandis to any considered strand.

In particular, it will be noted that each of the alternative embodiments of the infeed devices 6A, 6B, 6C, 6D, 6E shown in FIG. 1 can be applied to the first strand 2, to the second strand 3, to any of the strands used to produce the wire element 1, even possibly to all the strands used to manufacture the wire element 1. Each strand shown in said FIG. 1 therefore has, for the sake of simplifying the description, the double reference "2, 3".

Of course, the present disclosure relates to an installation 5 for implementing the method.

As will be seen hereinafter, said installation 5 can correspond to a ring spinning machine that will have been improved by particularly adding a tension control unit 30, or tension control units 30, thereto allowing the tension of the considered strand 2, 3 or, respectively, the respective tensions of the considered strands 2, 3 to be controlled in a closed loop.

In a manner per se known, the method comprises an infeed step (a), during which the first strand 2 and the second strand 3, respectively, are routed to an assembly point 4, at which the first strand 2 and the second strand 3 meet.

To this end, the installation 5 will comprise an infeed device 6 responsible for routing the first strand 2 and the second strand 3, respectively, to an assembly point 4, at which the first strand 2 and the second strand 3 meet.

In practice, as shown in FIG. 1, the infeed device 6 preferably will be arranged so as to allow the relevant strand 2, 3 to unwind and to be routed to the assembly point 4, from an input reel 7, on which said strand 2, 3 is initially stored.

It will be noted that one and/or other of the strands 2, 3 intended for the assembly may have undergone previous individual twisting, before being used by the installation 5, and thus may form one or more "overtwists", each stored on its respective input reel 7.

The infeed device 6 of the considered strand 2, 3 advantageously can comprise a motorized drive device 8.

Said motorized drive device 8 is located upstream of said assembly point 4 and is arranged to impart a speed, called "forward speed" V_fwd, to the considered strand 2, 3 in response to a drive setpoint that is applied to said motorized drive device 8.

Thus, the motorized drive device 8 allows the strand 2, 3 to be driven in a direction, called "routing direction" F, from the input reel 7 to the assembly point 4.

By convention, the routing direction F along which the strand 2, 3 moves from the input reel 7 towards the assembly point 4, then beyond, will be considered to be corresponding to an upstream-downstream direction of movement.

Preferably, the motorized drive device 8 will be formed by a capstan, as shown in FIG. 1.

In a manner per se known, such a capstan 8 can comprise two rollers 9, 10, including a motorized roller 9 and a free roller 10, wherein several turns of the considered strand 2, 3 are wound around said rollers, so as to drive the strand 2, 3 by friction.

A non-slip coating also optionally can be provided on the surface of the motorized roller 9 and/or of the free roller that improves the adhesion of the strand 2, 3 on the roller 9, 10.

As an alternative embodiment, any type of suitable motorized drive device 8 can be used instead of a capstan, for example, a trio of rollers 11, as shown in FIG. 2.

Such a trio of rollers 11 comprises three rollers 12, 13, 14, including a planetary roller 12, which preferably is free, and two satellite rollers 13, 14, which are preferably motorized and synchronized, said rollers 12, 13, 14 being arranged so that the strand 2, 3 is friction driven between said rollers, along an Ω (capital omega) shaped path.

In this configuration that is intended to move the strand 2, 3, the planetary roller 12 preferably can come into contact with the two satellite rollers 13, 14, and the cylindrical surface of the planetary roller 12 can be coated with a rubber non-slip layer, in order to improve the drive of said planetary roller 12 by the satellite rollers 13, 14.

Of course, the infeed device 6 can comprise a plurality of distinct motorized drive devices 8, each assigned to a different strand 2, 3.

Thus, a second motorized drive device 8, similar to the first motorized drive device but distinct therefrom, can be provided in addition to the first motorized drive device 8 assigned to the first strand 2, which second motorized drive device 8 is assigned to the second strand 3, and if applicable a third motorized drive device 8 is assigned to a third strand, etc.

The method also comprises an interlacing step (b), during which the first strand 2 and the second strand 3 are interlaced with each other, at the assembly point 4, so as to form a wire element 1 from said at least first and second strands 2, 3.

The interlacing preferably can be implemented by twisting so as to helically wind the second strand 3 around the first strand 2, or so as to helically wind the second strand 3 and the first strand 2 one around the other, in order to form the wire element 1.

Therefore, the installation 5 will comprise an interlacing device 15, and more specifically a twisting device 15, responsible for interlacing the first strand 2 and the second strand 3 with each other, at the assembly point 4, so as to form a wire element 1 from said at least first and second strands 2, 3.

The method will also comprise a discharge step (c), during which the wire element 1 is routed from the assembly point 4 towards an output station located downstream of the assembly point 4 and, more preferably, during which said wire element 1 is wound onto an output reel 16.

According to one possible arrangement, which is also per se known in a "ring spinning machine" type installation, the interlacing device 15 can comprise a guide eyelet 17, for example, made of ceramic, intended to guide the wire element 1 downstream of the assembly point 4, in this case directly downstream of the assembly point, as well as a ring 18, which is coaxial to the output reel 16 and on which a runner 19, which forms a point of passage for the wire element located downstream of the guide eyelet 17 and upstream of the output reel 16, is mounted so as to freely slide.

Thus, when the output reel 16 is rotated on its axis, preferably its vertical axis, by means of a motorized spindle 20 and thus exerts a traction force on the wire element 1, whilst the supply of strands 2, 3 is provided by the infeed device 6, the runner 19 adopts a relative rotation movement around the output reel 16, which causes a force for twisting the wire element 1, and therefore causes twisting of the strands 2, 3 at the assembly point 4, whilst guiding the progressive winding of said wire element 1 onto the output reel 16.

The ring 18 is also moved by a reciprocal translation movement along the axis of the output reel 16 so as to distribute the turns of the wire element 1 over the entire length of the output reel 16.

Furthermore, the infeed device 6 preferably can comprise a distributor 21 arranged to distribute the strands 2, 3 in the space and to do so in order to order the geometric configuration by which said strands 2, 3 converge towards the assembly point 4, which assembly point 4 is located downstream, in this case directly downstream, and more preferably just below, said distributor 21.

The distributor 21 can be in the form of a support plate 22, which defines a plurality of passage points 23 each intended to guide one of the strands 2, 3 originating from the input reels 7 and/or the motorized drive devices 8.

The passage points 23 can be formed, for example, by holes, preferably each provided with a ceramic distribution eyelet, or even by guide pulleys.

The passage points 23 define predetermined gaps between the various strands 2, 3 so that, from the base that the support plate 22 represents, the strands converge by following the edges of at least one polygon (flat), or even of at least one polyhedron (three-dimensional), the apex of which corresponds to the assembly point 4.

According to one possible use, the first strand 2 passes through a central passage point 23, around which the other passage points 23 are disposed that are intended for the other strands 3 forming the wire element 1.

According to a more specific possible use, the central passage point 23 can be arranged relative to the other passage points 23 so that the first strand 2 follows a trajectory, between the central passage point 23 and the assembly point 4, that substantially corresponds to a height of the polygon, respectively to a height of the polyhedron, formed by the other strands 3.

Advantageously, the use of a central passage point 23 particularly allows the first strand 2 to be used as a central core, around which the one or the other strands 3 will be wound.

According to the present disclosure, the method comprises a strand tension control step (a1).

The tension of the strand 2, 3 corresponds to the longitudinal traction force that is exerted inside the strand 2, 3 at the considered point, and therefore to the traction strain resulting from the application of this force.

By operating convention, the tension can be expressed in centi-Newtons (cN). It will be noted that a centi-Newton in practice substantially corresponds to the weight of a one gram mass, so that, by misuse of language, the tension of the strand sometimes can be expressed in "grams".

The strand tension control occurs in a closed loop.

To this end, during the strand tension control step (a1):

- a tension setpoint, called "assembly tension setpoint" T_set, is defined that represents a longitudinal tension state intended to be obtained in the first strand 2 when said first strand reaches the assembly point 4;
- the tension, called "actual assembly tension" T_actual, that is exerted inside said first strand 2 is measured at a first tension measurement point PT1 that is located along said first strand 2 and upstream of the assembly point 4 relative to the routing direction F of said first strand;
- a tension feedback loop is used to determine an error, called "tension error" ER_T, that corresponds to the difference between the assembly tension setpoint and the actual assembly tension of the first strand: ER_T=T_set−T_actual; and
- a tension regulating component 34 is controlled, on the basis of said tension error ER_T, which component acts on the first strand 2 upstream of the assembly point 4, so as to automatically converge, inside said first strand 2, the actual assembly tension T_actual towards the assembly tension setpoint T_set.

Therefore, the installation 5 comprises a tension control unit 30, arranged to control the tension of the considered strand in a closed loop according to an operating mode called "tension control mode", said tension control unit 30 to this end comprising:

- a tension setpoint setting component 31 that allows a setpoint, called "assembly tension setpoint" T_set, to be set that represents a longitudinal tension state intended to be obtained in the first strand 2 when said first strand reaches the assembly point 4;
- a tension monitoring component 32 that allows the tension, called "actual assembly tension" T_actual, that is exerted inside said first strand 2 to be measured at a first tension measurement point PT1 that is located along said first strand 2 and upstream of the assembly point 4 relative to the routing direction F of said first strand;
- a tension feedback component 33 that is used to assess an error, called "tension error" ER_T, that corresponds to the difference between the assembly tension setpoint T_set and the actual assembly tension T_actual of the first strand 2; and
- a tension regulating component 34, which is dependent on the tension feedback component 33 and which can act on the first strand 2 upstream of the assembly point 4, so as to automatically converge, inside said first strand, the actual assembly tension T_actual towards the assembly tension setpoint T_set.

The strand tension control unit 30, and more specifically one and/or other of the components 31, 32, 33, 34 for setting the tension setpoint, for monitoring tension, for feedback, for tension regulation, can comprise, or be formed by, any suitable computer or electronic controller.

Advantageously, the tension control thus can be implemented automatically, substantially in real time.

As stated in the introduction, the consideration of the tension of the strand 2, 3, and the resulting tension control according to the present disclosure, allows precise and repeatable control of the conditions for forming the wire element 1, and does so continuously, which allows properties to be obtained that are homogenous and compliant with the specifications over practically the entire, even the entire length of the wire element 1 that is obtained.

Of course, as stated above, it is perfectly feasible to provide a tension control unit 30 for one and/or other of the strands 3 other than the first strand 2, and in particular specifically for the second strand 3, which tension control unit is applied to the relevant strand 3 and which acts on said relevant strand independently of the tension control unit 30 that manages the first strand 2.

Thus, a similar structure to that described above can be provided for one and/or other of the strands 2, 3, and preferably for several of the strands to be assembled, possibly for all the strands to be assembled, which structure comprises, specifically for each relevant strand, a tension control unit 30 for the relevant strand, said tension control unit comprising a component 31 for setting an assembly tension setpoint T_set for the relevant strand, a component 32 for monitoring the actual tension T_actual of the relevant strand at a first tension measurement point PT1 located along said relevant strand, a feedback component 33, and a tension regulating component 34 that acts on said relevant strand to automatically converge the actual tension of the relevant strand towards the tension setpoint applicable to said strand.

To this end, a tension control unit 30 can be duplicated on several of the infeed devices 6, and preferably on each of the infeed devices 6 provided in the installation 5, so as to offer the possibility of controlling or of not controlling the tension of the relevant strand, and to do so individually and independently of the other strands.

Of course, if required, different assembly tension setpoints T_set can be set for different strands 2, 3, and separate control of each of said strands 2, 3 can be provided independently of the other strands.

Preferably, the actual assembly tension T_actual of the considered strand is measured by means of a tension monitoring component 32 comprising a thread guide 35, such as a freely rotating pulley or roller, which comes into abutment against the considered strand 2, 3, in this case at the selected tension measurement point PT1, and which is supported by a resiliently deformable support 36, the resilient deformation of which is measured by means of a suitable sensor 37, for example, by means of a strain gauge.

According to one possible use shown in FIG. 3, the tension monitoring component 32 can comprise a thread guide 35 formed by a pulley supported by a support 36 formed by a beam, preferably a horizontal beam, mounted as a cantilever.

Thus, the force exerted by the strand 2, 3 coming into abutment against the pulley 35 is expressed by bending of the beam 36 that can be measured using a suitable sensor, such as a strain gauge 37.

According to another possible use corresponding to FIG. 2, the tension monitoring component 32 can assume the shape of a trio of rollers 11, within which the freely rotating planetary roller 12 will form the thread guide 35 and will be mounted on a support 36 comprising a movable bearing that supports said planetary roller 12 and that engages with a resilient suspension component, of the spring type, so that the sensor 37 will measure the compression deformation of said spring or, similarly, will measure the movement of the planetary roller 12 and of its suspended bearing against said spring, so as to deduce therefrom the actual assembly tension T_actual of the considered strand.

According to one possible configuration, the planetary roller 12 then will be remote from the satellite rollers 13, 14 of the trio of rollers 11, which are also freely rotating, and the strand will follow an Ω-shaped route by passing below each satellite roller 13, 14 and above the planetary roller 12, so that the strand tension is expressed by a force that tends to bring the planetary roller 12 closer to the fictive straight line passing through the respective centers of the two satellite rollers.

According to another possible configuration, which particularly can correspond to the arrangement schematically shown on the branches 6A, 6B, 6C, 6D, 6E of the infeed device 6 of FIG. 1, the strand 2, 3 passes above the satellite rollers 13, 14 of the trio of rollers, and below the planetary roller 12, which is close enough to the satellite rollers 13, 14 to interfere with the strand 2, 3 and force said strand 2, 3, supported by the satellite rollers 13, 14, to circumvent said planetary roller 12, so that the tension of the strand 2, 3 is expressed by a force that tends to separate the planetary roller 12 from the fictive straight line passing through the respective centers of the two satellite rollers 13, 14.

Of course, any other suitable means, and in particular any suitable set of rollers or pulleys, can be used to assess the actual assembly tension T_actual, without departing from the scope of the present disclosure.

Furthermore, during the infeed step (a), the first strand 2 is preferably, as stated above, moved towards the assembly point 4 by means of a motorized drive device 8, such as a capstan, which is located upstream of said assembly point 4 and which is arranged to impart a speed, called "forward speed" V_fwd, to the first strand 2 in response to a drive setpoint that is applied to said motorized drive device 8.

Preferably, the first tension measurement point PT1 is then selected, where the actual assembly tension T_actual is measured, so that said first tension measurement point PT1 is located in a section of the first strand, called "approach section", that extends from the motorized drive device 8, upstream, and the assembly point 4, downstream.

Thus, advantageously, the actual assembly tension T_actual is measured at a measurement point PT1 that is between the position (considered along the path taken by the relevant strand) of the motorized drive device 8 and the position (considered along the path taken by the relevant strand) of the assembly point 4, and which therefore is particularly close to the assembly point 4.

More specifically, the tension measurement point PT1 thus selected therefore can be located between the assembly point 4 and the last motor element, in this case the motorized drive device 8, which precedes the assembly point 4, in the upstream-downstream routing direction of the strand 2, 3.

The actual assembly tension T_actual is therefore preferably measured downstream of the last motorized device (in this case the motorized drive device 8), which is liable to actively act on the considered strand 2, 3 and to significantly modify the tension before said strand 2, 3 reaches the assembly point 4.

To this end, it will be noted that the possible presence of one or even of several freely rotating passive return rollers 40, placed along the strand 2, 3 between the motorized drive device 8 and the assembly point 4 has little influence on the tension that prevails inside said strand 2, 3.

Consequently, the actual assembly tension T_actual measurement that is performed as close as possible to the assembly point 4, in an approach section that is not much subject to disturbance by external forces, is particularly reliable, and properly represents the tension that is actually exerted in the relevant strand 2, 3 when said strand reaches the assembly point 4.

As stated above, a similar tension measurement arrangement and operation can be found on any one of the strands 2, 3 forming part of the assembly.

In absolute terms, the use of a tension regulating component 34 can be contemplated that forms a controlled brake, which is capable of acting on the relevant strand 2, 3 by braking the progression of said strand 2, 3 to a certain extent.

The more the strand is braked by the tension regulating component 34 upstream of the assembly point 4, the higher the tension of said strand. Conversely, the more the brake is released, the less taut the strand 2.

The tension regulating component 34 then may comprise, for example, a friction roller, making contact with the strand 2, 3 and opposing, when the strand advances, a braking torque that is adjusted, for example, by means of a friction pad or a magnetic brake, as a function of the value of the tension error ER_T.

According to a preferred feature that can constitute an invention in its own right, during the strand tension control step (a1), the motorized drive device 8 preferably will be used, in particular the motorized drive device 8 associated with the first strand 2, as a tension regulating component 34, by adjusting, as a function of the tension error ER_T, the drive setpoint that is applied to said (first) motorized drive device 8.

Advantageously, the use of a motorized device allows, as a function of the measured tension error ER_T, either the strand 2, 3 to be slowed down upstream of the assembly point 4 by applying a slow enough forward speed V_fwd to the strand by means of the motorized device 8, the effect of which would be to retain the strand 2, 3 and therefore increase the tension of said strand 2, 3, or, on the contrary, to accelerate the strand 2, 3 upstream of the assembly point 4, i.e. to increase the forward speed V_fwd of said strand, the effect of which would be to reduce the tension of said strand 2, 3 by "slackening" said strand.

In this way, the actual assembly tension T_actual advantageously can be corrected and adapted, whilst actively promoting either the release of the strand 2, 3, or an accentuation of the tension of said strand 2, 3.

Furthermore, the use of the motorized drive device 8 as a tension regulating component 34 allows a compact and inexpensive installation 5 to be produced, since the same motorized drive device 8 is used both to infeed the relevant strand 2, 3 and to control the tension of said strand 2, 3.

Of course, here again, tension regulation can be provided mutatis mutandis, and in particular individual tension regulation can be provided, using a motorized drive device 8 in associated with the considered strand, on the entire strand 2, 3 intended for assembly and, if required, on several strands, possibly on all the strands intended for assembly.

Advantageously, it thus will be possible for as many tension regulations to be simultaneously and simply performed on a plurality of strands 2, 3, independently of one another.

According to another preferred feature that can constitute an invention in its own right, if, during the infeed step (a), the considered strand, for example, the first strand 2, is moved towards the assembly point 4 by means of a motorized drive device 8, such as a capstan, that is located upstream of the assembly point 4, in particular as described above, then the method can also comprise an unwinding step (a0), during which the considered strand, in this case the first strand 2, for example, is unwound from an input reel 7, by means of an unwinding device 50 that is distinct from the motorized drive device 8 (of the considered strand) and that is located upstream of said motorized drive device 8.

Such a possibility is particularly illustrated, in a non-limiting manner, in variants 6A and 6C of infeed devices 6 of FIG. 2.

The unwinding device 50 comprises a motorized reel holder 51 intended to receive and rotate, at a selected speed called "input reel speed" ω7, the relevant input reel 7.

Advantageously, as is particularly shown on the branch 6C of FIG. 1, it is then possible to measure, at a second tension measurement point PT2 that is located along the considered strand, in this case along the first strand 2, for example, between the motorized reel holder 51 and the motorized drive device 8, the tension, called actual "unwinding tension" T_unwind_actual, that is exerted in the first strand 2, and to consequently adjust the input reel speed ω7 so as to converge said actual unwinding tension T_unwind_actual towards a predetermined unwinding tension setpoint T_unwind_set.

Indeed, by controlling, on the one hand, upstream, the input reel speed ω7 and therefore the unwinding speed at which the strand 2, 3 is released and, on the other hand, downstream, the forward speed V_fwd imparted by the motorized drive device 8, the unwinding tension of the strand advantageously can be selected, which tension prevails between the unwinding device 50, upstream, and the motorized drive device, downstream.

Advantageously, the relevant strand 2, 3, which is present at the input of the motorized drive device 8, is thus provided with a well controlled actual unwinding tension T_unwind_actual, which sets a first pre-tension stage, from which it subsequently will be possible, by virtue of the action of the motorized drive device 8, to modify the tension state of the strand 2, 3 in the approach section, downstream of the motorized drive device 8 and upstream of the assembly point 4, in order to impart the desired actual assembly tension T_actual to said strand 2, 3.

With respect to this, the inventors have observed that the creation and the retention, by virtue of a dual motorization (successively that of the unwinding device 50, then that of the motorized drive device 8), of a tension pre-stress, in the form of an actual unwinding tension T_unwind_actual with an even and well controlled value, advantageously allowed more precise and easier adjustment of the actual assembly tension T_actual of the relevant strand.

Indeed, from the first tension stage, which is equal to the actual unwinding tension T_unwind_actual and which can be easily stabilized as much as necessary, it is possible, by an additive action exerted by the motorized drive device 8 (consisting in increasing the tension by braking the strand) or, on the contrary, by a subtractive action exerted by the motorized drive device 8 (consisting in reducing the tension by accelerating the strand), to precisely reach a resulting actual assembly tension T_actual, which forms a second tension stage and which can be freely selected from a very wide actual assembly tension range.

In absolute terms, by virtue of such a method with two tension stages, which uses two tension measurement points PT1, PT2 located upstream of the assembly point 4, on the same strand 2, 3, and separate from one another, the assembly tension setpoint T_set can be freely selected and a corresponding actual assembly tension T_actual can be reliably obtained, within a range with a lower limit that can be less than (by absolute value) the first tension stage, i.e.

less than the actual unwinding tension T_unwind_actual, and for which the upper limit can be greater than said first tension stage.

By way of an example, an unwinding tension T_unwind_set can be selected for the first tension stage (and therefore an actual unwinding tension T_unwind_actual can be obtained) that is between 50 cN (fifty centi-Newtons) and 600 cN and, for example, that is equal to 100 cN, 200 cN or 400 cN, and a precise and stable assembly tension T_actual can be obtained at the second tension stage that will fully comply with a setpoint T_set that will have been freely selected from a very broad possible range, between 15 cN (fifteen centi-Newtons, which corresponds to a mass of approximately 15 grams) and 100 N (one hundred Newtons, which corresponds to a mass of approximately ten kilograms), even between 5 cN (five centi-Newtons, which corresponds to a mass of approximately 5 grams) and 200 N (two hundred Newtons, which corresponds to a mass of approximately twenty kilograms).

It will be noted that, according to a preferred possible embodiment, the method advantageously allows to set an assembly tension setpoint T_set that is selected so as to be less than the unwinding tension setpoint T_unwind_set, and to obtain stable assembly tension control.

Furthermore, the inventors have observed that the existence of a first tension stage, defined by the unwinding tension, allows, in the second tension stage, the assembly tension to drop (both the assembly tension setpoint and the corresponding actual assembly tension) T_set, T_actual to a very low level, for example, of the order of several centi-Newtons (which by weight equals a mass of several grams) or of several tens of centi-Newtons (which by weight equals a mass of several tens of grams), without any risk of creating any tension jerking in the strand, and without any risk of causing the actual assembly tension T_actual to reach a zero value, which would risk causing the strand 2, 3 to exit the guides (pulleys, rollers, etc.) that define the route of said strand through the installation 5.

In particular, such a method particularly allows effective regulation to be obtained of the assembly tension for any assembly tension setpoint value T_set freely selected in an assembly tension range between T_actual=5 cN (five centi-Newtons) and T_actual=100 cN (one hundred centi-Newtons).

The tension measurement at the second tension measurement point PT2 can be performed by any tension monitoring component 32, as previously described and placed at said second measurement point PT2, for example, a trio of rollers 11 according to FIG. 2 or a pulley 35 as a cantilever according to FIG. 3.

According to a preferred feature that can constitute an invention in its own right, the installation 5 comprises a forward speed control unit 60 arranged to control the forward speed V_fwd of one of the strands 2, 3, preferably of the first strand 2, in a closed loop according to an operating mode called "speed control mode", said speed control unit 60 to this end comprising:

- a speed setpoint setting component 61 that allows a setpoint, called "forward speed setpoint" V_fwd_set, to be set that corresponds to a forward speed value intended to be imparted to the considered strand 2, 3, in this case the first strand 2, for example, upstream of the assembly point 4;
- a speed monitoring component 62 that allows measurement, at a forward speed measurement point PV1 that is located along said considered strand 2, 3, in this case along said first strand 2, for example, and upstream of the assembly point 4, of a speed value, called "actual forward speed" V_fwd_actual, that represents the actual forward speed of the considered strand, in this case of the first strand, for example, at the considered measurement point PV1;
- a speed feedback component 63 that allows an error, called "speed error" ER_V, to be assessed that corresponds to the difference between the forward speed setpoint and the actual forward speed of the considered strand 2, 3, in this case on the first strand: ER_V=V_fwd_set−V_fwd_actual; and
- a speed regulating component 64, which is dependent on the speed feedback component 63 and which can act on the considered strand 2, 3, in this case the first strand 2, for example, upstream of the assembly point 4, so as to automatically converge the actual forward speed V_fwd_actual of the considered strand 2, 3, in this case of the first strand 2, for example, towards the forward speed setpoint V_fwd_set.

The installation 5 can then preferably comprise a selector 70, which allows selective activation, for the first strand 2, of the tension control mode or of the speed control mode.

In other words, the present disclosure advantageously proposes offering the user a possibility of selecting, at least for the first strand 2 and, if applicable, for one and/or other of the other strands 3, between a mode for controlling the tension of said strand and a mode for controlling the forward speed of said strand.

Therefore, the method according to the present disclosure can provide a corresponding selection step.

Advantageously, the selector 70 allows the user to select, for the considered strand, and preferably on a strand-by-strand basis, whether he wante to perform tension regulation or speed regulation.

The installation 5, therefore provides significant operating versatility.

The selector 70 equally can be formed by any suitable mechanical, electromechanical, electronic or computer unit.

Preferably, the installation comprises one or more selectors 70 that allow selection, for each of the first and second strands 2, 3, and independently for each of the first and second strands 2, 3, of a tension control mode or, alternatively, of a speed control mode.

In this case, and, more generally, in the case where several, or possibly all the branches of the infeed device 6, i.e. if several, or possibly all the strands 2, 3, are each equipped with a tension control unit 30, a speed control unit 60 and a selector 70 for allowing switching between these two units 30, 60, then it is possible to implement multiple assembly combinations, within which a strand is tension regulated, and possibly several strands are tension regulated, whereas another strand, possibly several other strands, are speed regulated.

Of course, even though it is preferably possible to equip at least the same strand 2, possibly each one of all the strands 2, 3, equally with a tension control unit 30, a speed control unit 60 and a selector 70 so as to make it possible to alternatively implement either one of these units 30, 60 on the considered strand 2, it is also possible to make provision for separately equipping at least one first strand 2 of a tension control unit 30, and at least one other strand 3 of a speed control unit 60.

Thus, definitively, the present disclosure as such can relate to a method for manufacturing a wire element 1, during which at least one first strand 2 is tension controlled as described above, so as to impart a longitudinal tension state to said strand 2 when said strand 2 reaches the assembly point 4, which longitudinal tension state corresponds to a tension setpoint T_set, while simultaneously at least one second strand 3 is forward speed controlled, so as to impart a forward speed to the second strand 3 when said strand 3 reaches the assembly point 4, which forward speed corresponds to a determined forward speed setpoint V_fwd_set.

Of course, the present disclosure therefore can particularly relate to a corresponding installation 5, which comprises at least one tension control unit 30 for controlling the tension of the first strand 2 and one speed control unit 60 for controlling the forward speed of the second strand 3.

By virtue of the present disclosure, it is therefore easy to repeatedly produce numerous types of wire elements 1.

By way of an example, during the method according to the present disclosure it is particularly possible to separately control each of the first and second strands 2, 3, with the first strand 2 being tension controlled in accordance with the strand tension control step (a1), and the second strand 3, being controlled as a matter of choice:

- either by tension by applying, mutatis mutandis, a tension control step (a1) to the second strand (as this step has been described above with preferred reference to the first strand 2);
- or by speed in accordance with a speed control step (a2), whereby a forward speed setpoint V_fwd_set is set that corresponds to a forward speed value intended to be imparted to the second strand 3 upstream of the assembly point 4, and a speed regulating component 64 is used to act on the second strand 3 upstream of the assembly point 4, so as to automatically converge the actual forward speed V_fwd_actual of the second strand 3 towards the forward speed setpoint V_fwd_set. This speed control step (a2) of course can be performed using the speed control unit 60 described above.

As indicated above, a selection step clearly can be provided, if the two speed and tension control modes are available for the same strand, in this case the second strand 3, by which selection step a selector 70 is used to decide whether to opt for tension control of the second strand 3, by applying a tension control step (a1) to the second strand, or for speed control of the second strand 3, in accordance with a speed control step (a2).

It will be noted that the speed control mode is based on a forward speed measurement and does not use a measurement of the strand tension, which makes the two control modes independent of one another, and even exclusive of one another (in that it may be impossible to regulate, at the same point of a strand, both the forward speed of the strand and the tension of said strand).

To avoid overloading the drawings, the details of the speed control unit 60 and of its constituent components 61, 62, 63, 64 have only been shown on the branch 6A of the infeed device 6 of FIG. 1.

Of course, such an arrangement of the speed control unit 60 is nevertheless perfectly applicable, on its own or in combination with a tension control unit 30 and a selector 70, to one or other or possibly to all the other branches 6B, 6C, 6D, 6E of the infeed device 6, i.e. to one and/or other of the strands, to most of the strands, possibly to all the strands 2, 3.

Preferably, if one of the strands 3, for example, the second strand 3, is provided with a speed control unit 60 but without a tension control unit 30, then at least one other strand, for example, the first strand 2, will be provided with at least one tension control unit 30, even possibly with both a tension control unit 30 and a speed control unit 60, which will then be associated with a selector 70 for selectively opting for the use of one or other of these control units 30, 60 available at the first strand 2.

The strand speed control unit 60 and, more specifically, one and/or other of the components 61, 62, 63, 64 for setting the speed setpoint, for monitoring speed, for feedback, and for regulating speed can comprise, or be formed by, any suitable computer or electronic controller.

Advantageously, the speed control thus can be performed automatically, substantially in real time.

It also will be noted that the speed control, and in particular the measurement of the actual forward speed V_fwd_actual of the considered strand 2, 3, preferably occurs in the vicinity of the assembly point 4 and, for example, in the approach section that is comprised between the last motorized element that precedes the assembly point 4 and said assembly point 4, so that the considered forward and controlled speed represents the forward speed at which the strand 2, 3 reaches the assembly point 4.

Preferably, the speed measurement point PV1 can be located at the motorized drive device 8.

To this end, on may use for example, as a speed monitoring component 62, a rotary speed sensor integrated in the motor that actuates said motorized drive device 8, for example a rotary speed sensor integrated in the motor that drives the motorized roller of the capstan 8 or of the trio of rollers 11 that form said motorized drive device 8.

According to a preferred feature that can constitute an invention in its own right, if the infeed device 6 comprises a motorized drive device 8, such as a capstan, in particular as described above, that is located upstream of said assembly point 4 and that moves the first strand 2 towards the assembly point 4, then, preferably, said motorized drive device 8 can alternatively form, according to the control mode defined by the selector 70, the tension regulating component 34 used by the tension control unit 30 or the speed regulating component 64 used by the speed control unit 60.

Advantageously, the present disclosure therefore proposes selectively using the same motorized drive device 8 either as a tension regulator 34 or as a speed regulator 64 for the considered strand 2, 3.

Such use of a means common to the two control modes advantageously allows the structure of the installation 5 to be simplified and allows the cost and the spatial requirement of said installation 5 to be reduced.

Solely by way of an illustration, a brief description of the variants of branches 6A, 6*b*, 6C, 6D, 6E of the infeed device 6 shown in FIG. 1 is provided hereafter.

The branch 6A enables a selection to be made, by virtue of the selector 70, between a tension control mode (unit 30) and a speed control mode (unit 60); it is the assembly tension control mode that is active here. It is supplemented by an unwinding device 50 with a motorized reel holder 51.

The branch 6B shows "basic" unwinding, with a freely rotating input reel 7. The tension control is available, but inactive.

The branch 6C proposes a motorized unwinding device 50, which allows the strand unwinding tension T_unwind_actual to be controlled and which feeds a motorized drive device 8, in this case of the capstan type, which achieves tension control. Regulation is thus obtained according to a two tension stages.

The branch 6D is a variant of the branch 6B, inside which the unwinding of the input reel 7 with a vertical axis has been replaced by unwinding, referred to as "over-end" unwinding, from an input reel 7 with a horizontal axis.

The branch 6E is a variant of the branch 6A, inside which the unwinding of the input reel 7 with a vertical axis has been replaced by unwinding, referred to as "over-end" unwinding, from an input reel 7 with a horizontal axis, and inside which assembly tension control has been selected and the selector 70 has been accordingly configured to activate the tension control unit 30 and to deactivate the speed control unit 60.

Of course, the present disclosure is by no means limited to only the alternative embodiments described above, with a person skilled in the art being particularly able to freely isolate or combine together any of the features mentioned above, or replace them with an equivalent feature.

The invention claimed is:

1. A method for manufacturing a wire element by interlacing at least one first strand and one second strand distinct from the first strand, said method comprising the following steps:

an infeed step (a), during which the first strand and the second strand, respectively, are routed to an assembly point, at which the first strand and the second strand meet;

an interlacing step (b), during which the first strand and the second strand are interlaced with each other, at the assembly point, so as to form a wire element from said at least first and second strands, selecting either a tension mode a tension control mode or a speed control mode;

in response to the selection of the tension control mode, said method comprising a strand tension control step (a1), in a closed loop, during which step:

a tension setpoint, called "assembly tension setpoint", is defined that represents a longitudinal tension state intended to be obtained in the first strand when said first strand reaches the assembly point;

the tension, called "actual assembly tension" (T_actual), that is exerted inside said first strand is measured at a first tension measurement point that is located along said first strand and upstream of the assembly point relative to the routing direction of said first strand;

a tension feedback loop is used to determine an error, called "tension error" (ER_T), that corresponds to the difference between the assembly tension setpoint and the actual assembly tension of the first strand; and a tension regulating component is controlled, on the basis of said tension error, which component acts on the first strand upstream of the assembly point, so as to automatically converge, inside said first strand, the actual assembly tension (T_actual) towards the assembly tension setpoint (T_set); and in response to the selection of the speed control mode, said method comprising a speed control step, in a closed loop, during which step:

a speed setpoint setting component that allows a setpoint, called "forward speed setpoint", is defined that represents a forward speed value intended to be imparted to the first strand upstream of the assembly point, a forward speed value, called "actual forward speed" of the first strand is measured at a speed measurement point upstream of the assembly point, an error, called "speed error", is calculated to be the difference between the forward speed setpoint and the actual forward speed of the first strand, and a speed regulating component, which is dependent on the speed feedback component and which can act on the first strand upstream of the assembly point, automatically converges the actual forward speed of the first strand towards the forward speed setpoint.

2. The method according to claim 1, wherein, during the infeed step (a), the first strand is moved towards the assembly point by means of a motorized drive device that is located upstream of said assembly point and is configured to act as the speed regulating component to impart a speed, called "forward speed", to the first strand in response to the selection of the speed control mode and is configured to act as the tension regulating component to impart a tension in the first strand in response to the selection of the tension control mode.

3. The method according to claim 2, wherein, during the strand tension control step (a1), the motorized drive device is used as a tension regulating component by adjusting, as a function of the tension error, the drive setpoint that is applied to said motorized drive device.

4. The method according to claim 1, wherein, during the infeed step (a), the first strand is moved towards the assembly point by means of a motorized drive device that is located upstream of the assembly point, and wherein said method comprises an unwinding step (a0), during which the first strand is unwound from an input reel, by means of an unwinding device, which is distinct from the motorized drive device and which is located upstream of said motorized drive device and which comprises a motorized reel holder intended to receive and to rotate the input reel, at a selected speed called "input reel speed", and wherein the tension, called actual "unwinding tension", that is exerted in the first strand is measured at a second tension measurement point that is located along the first strand, between the motorized reel holder and the motorized drive device, and the input reel speed is adjusted so as to converge said actual unwinding tension towards a predetermined unwinding tension setpoint.

5. The method according to claim 1, wherein each of the first and second strands is controlled separately, the first strand in accordance with the strand tension control step (a1), and the second strand in accordance with a speed control step (a2), by which a forward speed setpoint is set that corresponds to a forward speed value intended to be imparted to the second strand upstream of the assembly point, and a speed regulating component is used that acts on the second strand upstream of the assembly point, so as to automatically converge the actual forward speed of the second strand towards the setpoint forward speed.

6. The method according to claim 1, wherein it comprises a selection step, by which a decision is taken to opt either for tension control of the second strand by applying, mutatis mutandis, a tension control step (a1) to the second strand, or for speed control of the second strand in accordance with a speed control step (a2), by which a forward speed setpoint is set, which corresponds to a forward speed value intended to be imparted to the second strand upstream of the assembly point, and a speed regulating component is used that acts on the second strand upstream of the assembly point, so as to automatically converge the actual forward speed of the second strand towards the forward speed setpoint.

7. The method according to claim 1, wherein the actual assembly tension of the considered strand is measured by means of a tension monitoring component comprising a thread guide which comes into abutment against the first strand and which is supported by a resiliently deformable support, the resilient deformation of which is measured by means of a suitable sensor.

8. The method according to claim 1, wherein, during the interlacing step (b), the interlacing is carried out by twisting so as to helically wind the second strand around the first strand or to helically wind the second strand and the first strand around each other, so as to form the wire element.

9. An installation for manufacturing a wire element by interlacing at least one first strand and one second strand distinct from the first strand, said installation comprising:

an infeed device responsible for routing the first strand and the second strand, respectively, to an assembly point, at which the first strand and the second strand meet;

an interlacing device responsible for interlacing the first strand and the second strand with each other, at the assembly point, so as to form a wire element from said at least first and second strands, wherein said installation comprises a selector that allows the installation to operate in a "tension control mode" or a "speed control mode;"

a tension control unit, arranged to control the strand tension in a closed loop according to the tension control mode, said tension control unit to this end comprising:

a tension setpoint setting component that allows a tension setpoint, called "assembly tension setpoint", to be set that represents a longitudinal tension state intended to be obtained in the first strand when said first strand reaches the assembly point;

a tension monitoring component that allows the tension, called "actual assembly tension", that is exerted inside said first strand to be measured at a first tension measurement point that is located along said first strand and upstream of the assembly point relative to the routing direction of said first strand;

a tension feedback component that is used to assess an error, called "tension error", that corresponds to the difference between the assembly tension setpoint and the actual assembly tension of the first strand; and a tension regulating component, which is dependent on the tension feedback component and which can act on the first strand upstream of the assembly point, so as to automatically converge, inside said first strand, the actual assembly tension towards the assembly tension setpoint; and a forward speed control unit arranged to control the forward speed of the first strand in a closed loop according to the speed control mode, said forward speed control unit to this end comprising:

a speed setpoint setting component that allows a setpoint, called "forward speed setpoint", to be set that corresponds to a forward speed value intended to be imparted to the first strand upstream of the assembly point;

a speed monitoring component that allows measurement, at a forward speed measurement point that is located along said first strand and upstream of the assembly point, of a speed value, called "actual forward speed", that represents the actual forward speed of the first strand at the considered measurement point a speed feedback component that allows an error, called "speed error", to be assessed that corresponds to the difference between the forward speed setpoint and the actual forward speed of the first strand; and a speed regulating component, which is dependent on the speed feedback component and which can act on the first strand upstream of the assembly point, so as to automatically converge the actual forward speed of the first strand towards the forward speed setpoint.

10. The installation according to claim 9, wherein the selector is a first selector and further including a second selector so that each of the first and second strands can be independently set into the tension control mode or the speed control mode.

11. The installation according to claim 9 wherein the infeed device comprises a motorized drive device that is located upstream of said assembly point and that moves the first strand towards the assembly point, and wherein said motorized drive device alternatively forms, according to the control mode defined by the selector, the tension regulating component used by the tension control unit or the speed regulating component used by the forward speed control unit.

12. The installation according to claim 9, further comprising at least one tension control unit for controlling the tension of the second strand and a forward speed control unit for controlling the forward speed of the second strand.

* * * * *